US008506191B2

(12) United States Patent
Yamamoto

(10) Patent No.: US 8,506,191 B2
(45) Date of Patent: Aug. 13, 2013

(54) IMAGE FORMING APPARATUS

(75) Inventor: Koyo Yamamoto, Nisshin (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 377 days.

(21) Appl. No.: 12/883,440

(22) Filed: Sep. 16, 2010

(65) Prior Publication Data

US 2011/0135368 A1 Jun. 9, 2011

(30) Foreign Application Priority Data

Dec. 3, 2009 (JP) ..... 2009-275369

(51) Int. Cl.
*B41J 29/02* (2006.01)

(52) U.S. Cl.
USPC ..... 400/693; 400/691

(58) Field of Classification Search
USPC ..... 400/693
See application file for complete search history.

(56) References Cited

U.S. PATENT DOCUMENTS

| | | | | |
|---|---|---|---|---|
| 5,085,422 | A * | 2/1992 | Sagara | 271/162 |
| 5,573,235 | A * | 11/1996 | Asai | 271/121 |
| 7,131,644 | B2 * | 11/2006 | Williamson et al. | 271/121 |
| 7,290,952 | B2 * | 11/2007 | Kagami | 400/693 |
| 7,416,181 | B2 * | 8/2008 | Murakami et al. | 271/162 |
| 7,553,099 | B2 * | 6/2009 | Bandou et al. | 400/624 |
| 7,677,556 | B2 * | 3/2010 | Murayama et al. | 271/162 |
| 7,748,691 | B2 * | 7/2010 | Mizuguchi | 271/9.09 |
| 8,150,294 | B2 * | 4/2012 | Okabe et al. | 399/118 |
| 2002/0166208 | A1 * | 11/2002 | Kondo et al. | 16/289 |
| 2003/0052953 | A1 | 3/2003 | Sai | |
| 2003/0052956 | A1 | 3/2003 | Katsuyama | |

FOREIGN PATENT DOCUMENTS

| | | | |
|---|---|---|---|
| JP | 09-190029 | | 7/1997 |
| JP | 2003-089249 | | 3/2003 |
| JP | 2003-263091 | A | 9/2003 |
| JP | 2003-307862 | A | 10/2003 |
| JP | 2008-137764 | A | 6/2008 |
| JP | 2008-297054 | | 12/2008 |
| JP | 2008-308329 | | 12/2008 |
| JP | 2009-196087 | A | 9/2009 |

OTHER PUBLICATIONS

JP Notification of Reason for Refusal dated Nov. 1, 2011 received in corresponding Application No. 2009-275369; English Translation.
CN Office Action mailed Mar. 5, 2013, CN Appln. 201010511707.0, English translation.

* cited by examiner

*Primary Examiner* — Anthony Nguyen
(74) *Attorney, Agent, or Firm* — Banner & Witcoff, Ltd.

(57) ABSTRACT

An image forming apparatus includes a main body having a first opening; a main cover supported by the main body, having a second opening and rotatable between a first closed position and a first opening position with respect to the first opening; a feeder cover supported by the main cover and rotatable between a second closed position and a second opening position with respect to the second opening; and a link arm jointed to the main body at a first joint, jointed to the main cover at a second joint, the first joint movable relative to the main body, and the link arm rotating the feeder cover from the second opening position toward the second closed position when the main cover rotates from the first closed position with the feeder cover at the second opening position.

8 Claims, 6 Drawing Sheets

IMAGE FORMING APPARATUS

CROSS REFERENCE TO RELATED APPLICATION

The present application claims priority from Japanese Patent Application No. 2009-275369 filed on Dec. 3, 2009, and subject matter of which is incorporated herein by reference.

TECHNICAL FIELD

The present invention relates to an image forming apparatus having a feeder cover that opens and closes an opening for inserting a sheet.

BACKGROUND

There is a related image forming apparatus comprising a main cover that is rotatably provided for a main body of the apparatus and a feeder cover (a cover of a manual sheet feeding part) that is rotatably provided for the main cover.

In the above image forming apparatus, when the main cover is opened with the feeder cover being opened, the feeder cover approaches an installation surface of the image forming apparatus. Accordingly, when an object is put on the installation surface (specifically, the installation surface of the main cover side), the feeder cover may interfere with the object.

SUMMARY

Accordingly, exemplary embodiments of the invention address the above described problem. The exemplary embodiments prevent an image forming apparatus from interference between a feeder cover and an object when a main cover is opened even though the object is put on an installation surface.

A first aspect of the exemplary embodiments of the present invention is an image forming apparatus comprising: a main body having a first opening on a side surface thereof; a main cover supported by the main body, having a second opening and rotatable between a first closed position and a first opening position, the main cover covering the first opening at the first closed position and uncovering the first opening at the first opening position; a feeder cover supported by the main cover and rotatable between a second closed position and a second opening position, the feeder cover covering the second opening at the second closed position and uncovering the second opening at the second opening position; and a link arm jointed to the main body at a first joint, jointed to the main cover at a second joint and stopping the rotation of the main cover at the first opening position while the main cover rotates, the first joint movable relative to the main body, and the link arm rotating the feeder cover from the second opening position toward the second closed position when the main cover rotates from the first closed position with the feeder cover at the second opening position.

According to the above described exemplary embodiment, even when the main cover is opened with the feeder cover being opened, the feeder cover automatically approaches the main cover. Accordingly, it is possible to prevent the feeder cover from interfering with an object put on an installation surface of the image forming apparatus. In addition, since the rotation of the feeder cover is controlled by the link arm that supports the main cover, it is possible to reduce the number of parts and thus to simplify the apparatus.

According to the exemplary embodiments of the present invention, even when an object is put on an installation surface of the image forming apparatus, it is possible to prevent the interference between the feeder cover and the object when the main cover is opened.

DESCRIPTION OF EXEMPLARY EMBODIMENTS

<Overall Structure of Laser Printer>

Hereinafter, exemplary embodiments of the invention will be described with reference to the drawings. In the below descriptions, an overall structure of a laser printer, which is an example of an image forming apparatus, will be first explained and characteristics of the embodiment will be then explained.

In the below descriptions, a direction is defined as defined as below. The left side in FIG. 1 is referred to as "the front (forth)," the right side is referred to as "the rear (back)," the back is referred to as "the left" and the forth is referred to as "the right." In addition, the vertical directions in FIG. 1 are referred to as "up and down directions."

Figure 1:
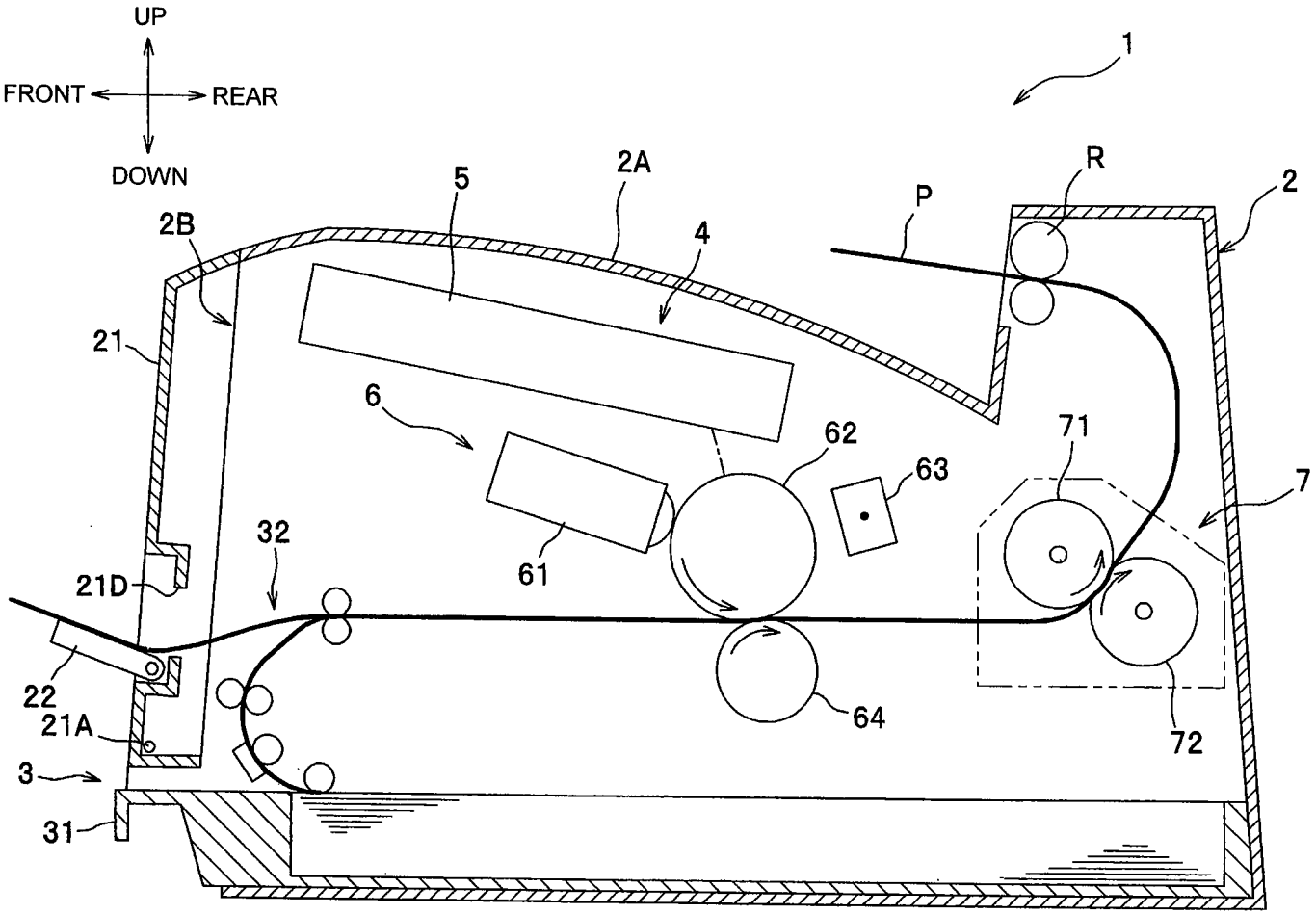
FIG. 1 illustrates an overall structure of a laser printer.

As shown in FIG. 1, a laser printer 1 has a feeder unit 3 that feeds a sheet P into a main body 2 and an image forming unit 4 that forms an image on the sheet P.

The feeder unit 3 has a feeding tray 31 and a feeding mechanism 32. The feeding tray 31 is detachably mounted to a lower part of the main body 2. The feeding mechanism 32 feeds the sheets P, which are stored in the feeding tray 31, toward the image forming unit 4.

The image forming unit 4 has a scanner unit 5, a processor unit 6, a photographic fixing device 7 and the like.

The scanner unit 5 is provided at an upper part in the main body 2 and has a laser light emitting part, a polygon mirror, a lens and a reflector, which are not shown. The scanner unit 5 scans a laser beam at high speed on a surface of a photosensitive drum 62 that will be described below.

The process unit 6 has a development cartridge 61, the photosensitive drum 62, a charger 63 and a transfer roller 64, which are well known.

In the process unit 6, the surface of the photosensitive drum 62 being rotated is uniformly charged by the charger 63 and then is exposed by the high speed scanning of the laser beam from the scanner unit 5. Thereby, a potential of the exposed part is lowered so that an electrostatic latent image based on image data is formed on the surface of the photosensitive drum 62.

Then, toner in the development cartridge 61 is supplied to the electrostatic latent image on the photosensitive drum 62 so that a toner image is formed on the surface of the photosensitive drum 62. After that, the sheet P is delivered between the photosensitive drum 62 and the transfer roller 64 so that the toner image on the photosensitive drum 62 is transferred on the sheet P.

The photographic fixing device 7 has a heating roller 71 and a pressing roller 72 that is opposed to the heating roller 71 and presses the heating roller 71. In the photosensitive fixing device 7, the toner transferred on the sheet P is heat-fixed while the sheet P passes between the heating roller 71 and the pressing roller 72.

The sheet P heat-fixed in the photographic fixing device 7 is delivered to a sheet discharge roller R that is arranged at a downstream side of the photographic fixing device 7 and then is sent on a sheet discharge tray 2A from the sheet discharge roller R.

Further, a front cover 21 that is rotatably provided for the main body 2. The front cover 21 is an example of a main cover. A feeder cover 22 is rotatable provided for the front cover 21. The feeder cover 22 is provided at the front (one side) of the main body 2. In the followings, the front cover 21 and the feeder cover 22 will be specifically described.

<Front Cover>

Figure 2:
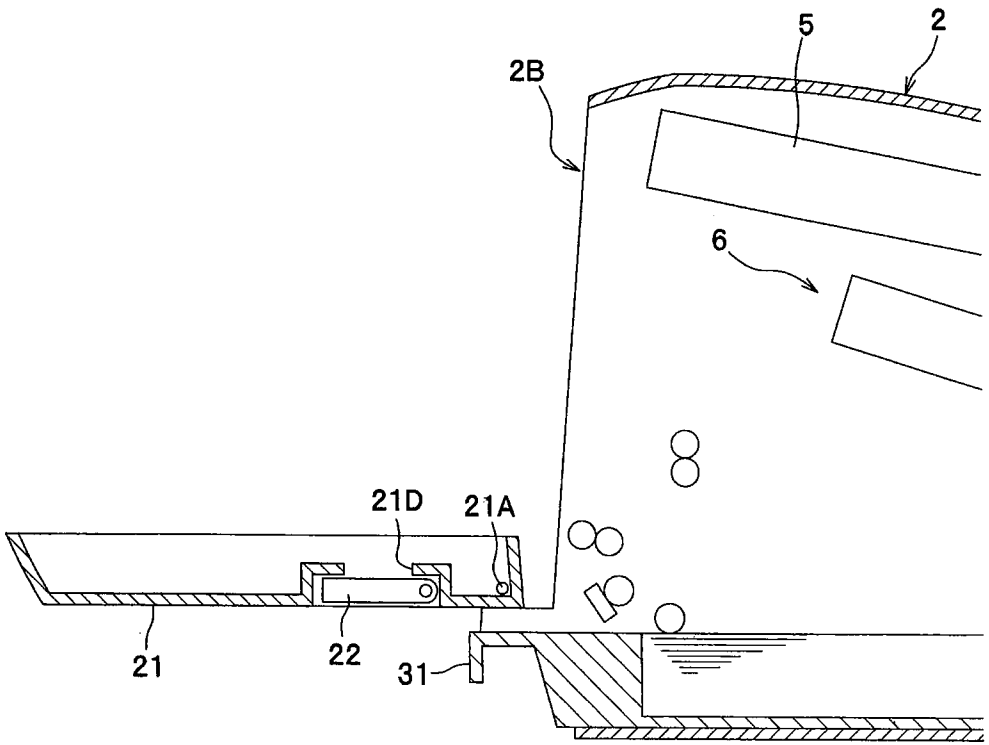
FIG. 2 illustrates a state in which a front cover is opened.

The front cover 21 is provided for covering a first opening 2B through which the process unit 6 provided for the front side of the main body 2 is mounted into the main body 2. The front cover 21 is supported by the main body 2 so that the front cover 21 can rotates between a first closed position (a position shown in FIG. 1) at which the front cover 21 covers the first opening 2B and a first opened position (a position shown in FIG. 2) at which the front cover uncovers the first opening 2B (in other words the first opening 2B is opened). As shown in FIG. 2, a rotational shaft 21A (center of rotation) of the front cover 21 is arranged above a feeding tray 31 by a predetermined space so that the feeding tray 31 can be pulled out (drawable) to the forth (one side) even when the front cover 21 is opened.

In other words, the front cover 21 and the feeder cover 22 are located above the upper surface of the feeding tray 31 at the first opened position so that the front cover 21 and the feeder cover 22 are not overlapped with the feeding tray 31, when seen from the pulling direction of the feeding tray 31.

Figure 3:
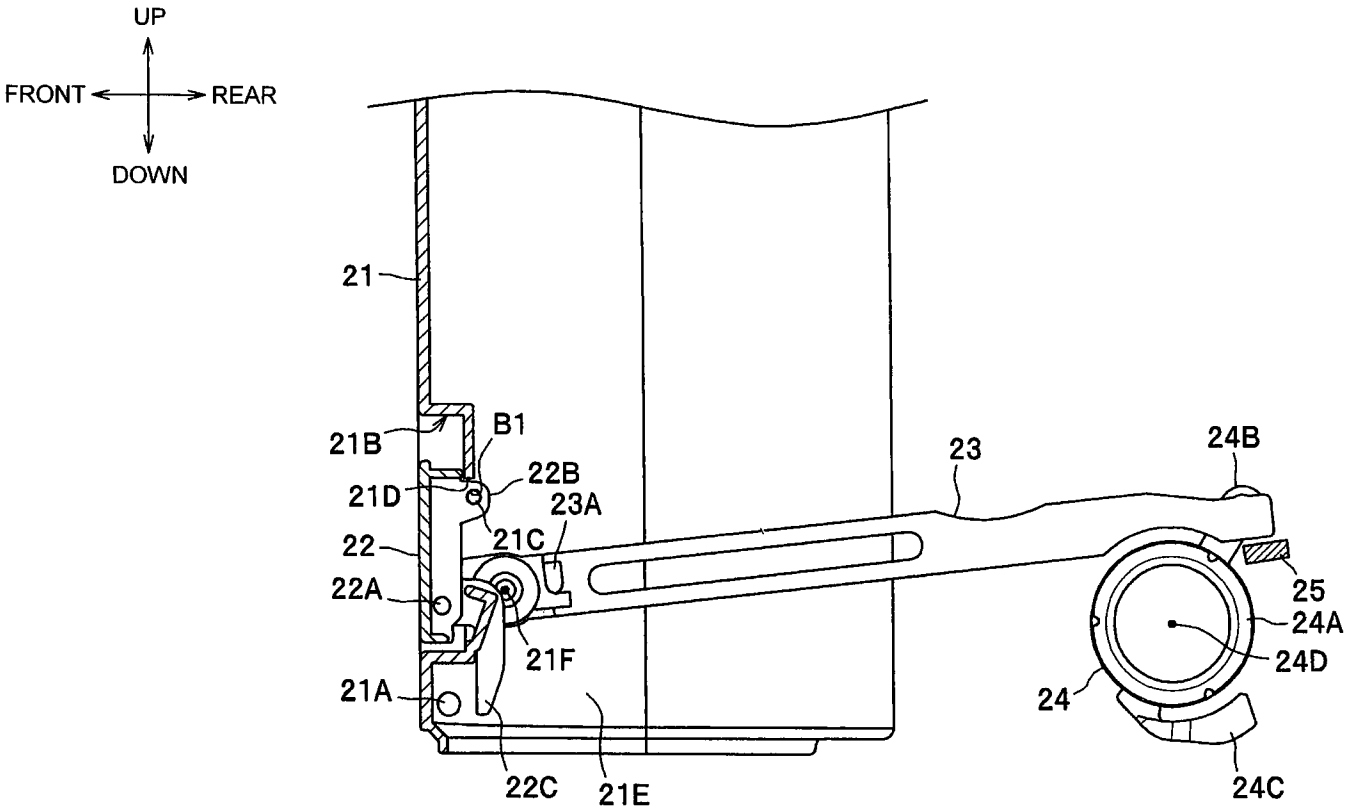
FIG. 3 is a sectional view showing a relation among a front cover, a feeder cover and a link arm, in which the front cover is located at a first closed position and the feeder cover is located at a second closed position.

In addition, as shown in FIG. 3, a recess 21B capable of accommodating the feeder cover 22 is backwardly formed at a front surface of the front cover 21. A second opening 21D for manually inserting the sheet P into the main body 2 is formed at a lower part of a rear wall (bottom wall) of the recess 21B.

Figure 4:
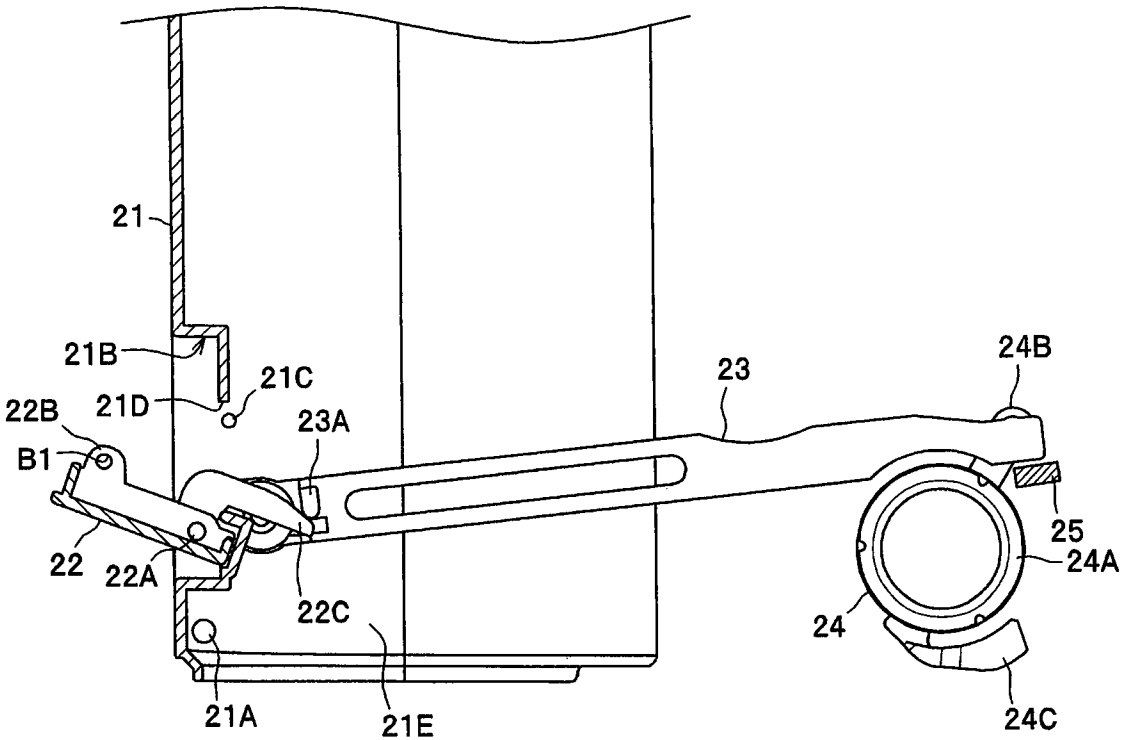
FIG. 4 is a sectional view showing a state in which the front cover is located at the first closed position and the feeder cover is located at a second opened position.

In addition, as shown in FIG. 4, an engagement protrusion 21C, which is engaged with an engagement opening B1 of a projection 22B provided for the feeder cover 22, is formed at a side wall 21E of the front cover 21. Herein, the engagement protrusion 21C and the engagement opening B1 are an example of an engagement part that keeps the feeder cover 22 at a closed state (second closed position) regarding the front cover 21.

The front cover 21 is connected to the main body 2 through a link arm 23.

The link arm 23 is a long member that is substantially extended in the forward and backward directions when the front cover 21 being closed. The link arm 23 has a front end portion (the second joint), which is rotatably connected to a shaft 21F rearward arranged below the recess 21B regarding the side wall 21E of the front cover 21, and a rear end portion (the first joint), which is connected to the main body 2 through a swing arm 24 to be movable forward and backward. In other words, the swing arm 24, which is a connection part of the link arm 23 to the main body 2, is structured in such a way that a leading end portion thereof can be rotated (moved) about a center of rotation 24D that is not movable regarding the main body 2. In addition, the shaft 21F is arranged at a position different from the rotational shaft 21A of the front cover 21 and is fixed to the side wall 21E of the front cover 21.

The swing arm 24 has a body 24A, a support arm 24B, and a control arm 24C. The body 24A is rotatably supported to the main body 2. The support arm 24B is upwardly protruded from the body 24A and is rearwardly inclined when the front cover 21 is closed. The control arm 24C has a substantial L-shape and is provided at a part opposite to the support arm 24B of the body 24A. Additionally, the main body 2 is provided with a stopper 25 that contacts the control arm 24C when the front cover 21 is opened to the first opened position, thereby stopping the moving of the control arm 24C.

Figure 6:
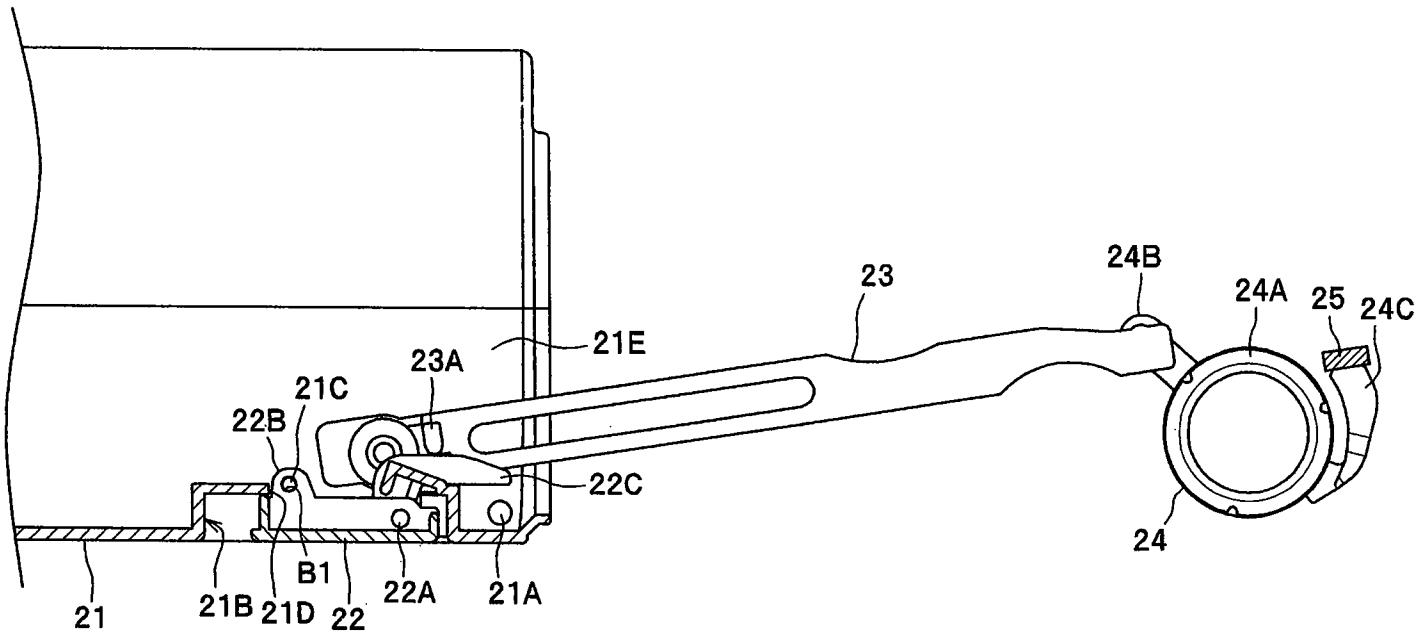
FIG. 6 is a sectional view showing a state in which the front cover is located at a first opened position and the feeder cover is located at the second closed position.

Thereby, the movements of the swing arm 24 and the link arm 23 are stopped, so that the front cover 21 is kept at the first opened position (refer to FIG. 6). In addition, the link arm 23 and the swing arm 24 may be provided for at least one of the right and left side walls of the main body 2.

<Feeder Cover>

The feeder cover 22 is supported to the front cover 21 so that the feeder cover 22 can be rotated to a second closed position (a position shown in FIG. 3) at which the feeder cover 22 covers the second opening 21D (refer to FIG. 1) formed at the front cover 21 and a second opened position (a position shown in FIG. 4) at which the feeder cover uncovers the second opening 21D (in other words, the second opening 21D is opened). The feeder cover 22 has a function of a manual feeding tray on which the sheets P are stacked as well as a function of covering the second opening 21D. In addition, the feeder cover 22 (feeder cover) may be a MP tray that stacks a plurality of sheets thereon and feeds the sheets to the main body in regular sequence.

In other words, although the manual feeding tray is integrally formed with the feeder cover 22 in this embodiment, the exemplary embodiment of the invention is not limited thereto. For example, it may be possible that the manual feeding tray and the feeder cover are separately provided and the feeding tray can be pulled out after the feeder cover is opened.

To be more specific, the feeder cover 22 is a plate-shaped member that is formed to be narrower than the width of the recess 21B along the up-down direction. The feeder cover 22 is arranged close to the lower side of the recess 21B and is provided at lower end portion of the recess 21B with a rotational shaft 22A. The feeder cover 22 is rotatably supported to the right and left sides of the recess 21B through the rotational shaft 22A. Accordingly, a user can open the feeder cover 22 by catching and pulling with a finger at an upper end portion of the feeder cover 22 from a vacant space formed between an upper part of the feeder cover 22 and the recess 21B. In addition, the rotational shaft 22A (center of rotation) of the feeder cover 22 is arranged upper side as compared to the rotational shaft 21A (center of rotation) of the front cover 21 (i.e., arranged at an outside of the rotational shaft 21A in a diametrical direction) when the front cover 21 is located at the first closed position.

An upper part of the feeder cover 22 (an opposite part to the rotational shaft 22A) is formed with a projection 22B that is rearwardly protruded when the feeder cover 22 is at the second closed position. The projection 22B is formed with an engagement opening B1 with which the engagement protrusion 21C of the front cover 21 is engaged. In addition, a lower part of the feeder cover 22 (a part near the rotational shaft 22A) is provided with a substantially L-shaped lever 22C that is rearwardly protruded and then bent downwardly.

As shown in FIG. 4, the lever 22C is contacted (engaged) to a projection 23A that is formed to inwardly protrude in the right and left direction from the front end portion of the link arm 23 when the feeder cover 22 is located at the second opened position with the front cover 21 being located at the first closed position. Thereby, the feeder cover 22 is kept at the second opened position.

Figure 5:
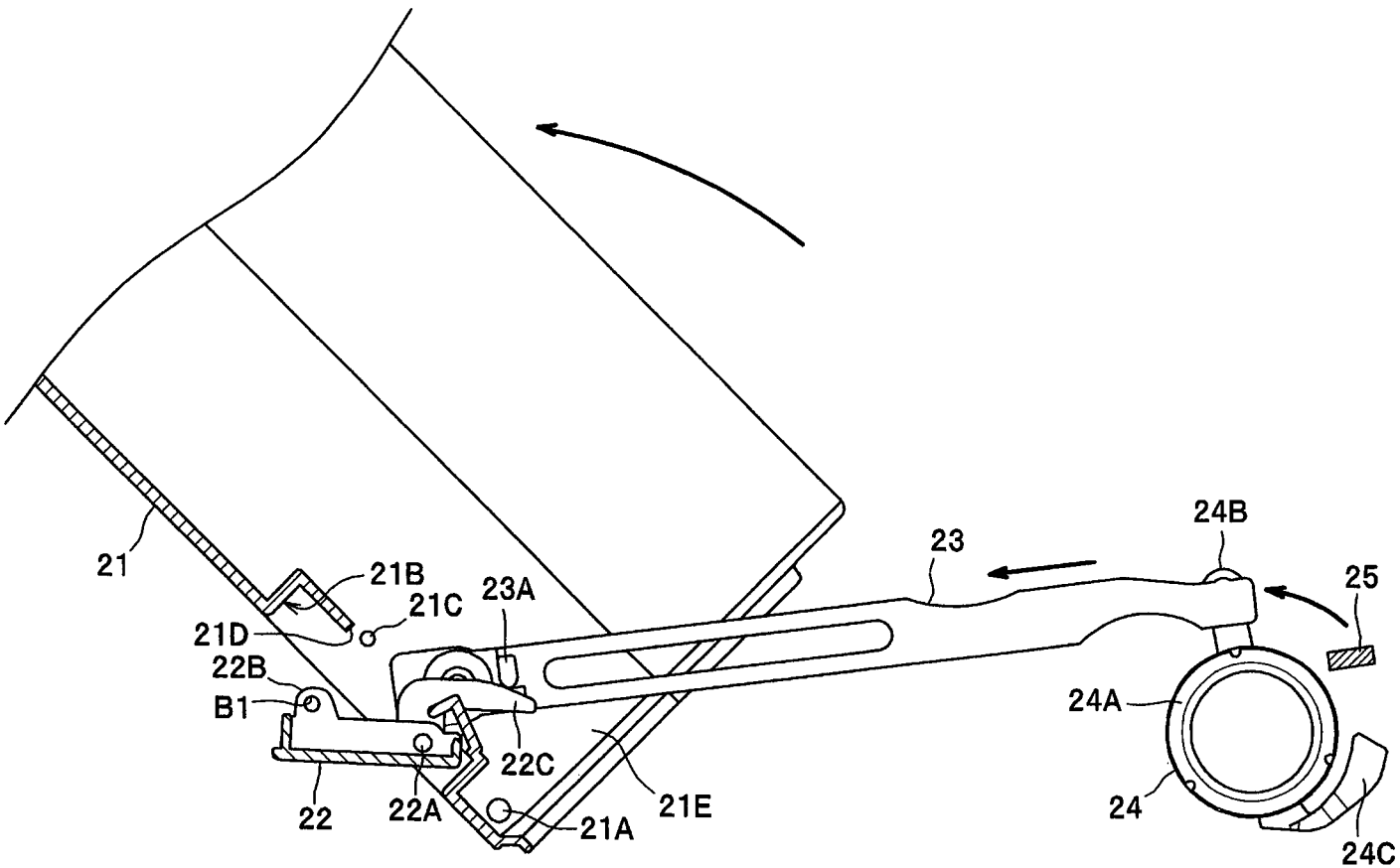
FIG. 5 is a sectional view showing a state during which the front cover is being opened from the state shown in FIG. 4.

As shown in FIGS. 5 and 6, the lever 22C is configured to always touch and slide to the projection 23A while the front cover 21 is moved to the first opened position with the feeder cover 22 being at the second opened position. To be more specific, touch and slide surfaces of the lever 22C and the projection 23A are formed into a tapered or cylindrical surface so that an angle defined between the feeder cover 22 and the front cover 21 is gradually decreased while the front cover 21 is moved to the first opened position with the feeder cover 22 being opened to the second opened position.

In other words, the projection 23A of the link arm 23 abuts the lever 22C of the feeder cover 22 so as to control the rotation of the feeder cover 22 relative to the main body 2. Accordingly, the feeder cover 22 rotates toward the second closed position relative to the rotating front cover 21 when the front cover 21 rotates toward the first opened position with the feeder cover 22 being at the second opened position.

Furthermore, the feeder cover 22 is configured to rotate to the second closed position, i.e., to be completely closed when the front cover 21 completes its rotation from the first closed position to the first opened position while the feeder cover 22 being opened to the second opened position.

In the followings, a method of operating the feeder cover 22 and the front cover 21 will be described.

As shown in FIGS. 3 and 4, it is possible to feed the sheets by opening the feeder cover 22 with regard to the closed front cover 21. In addition, as shown in FIG. 4, the feeder cover 22 located at the second opened position is securely kept at the second opened position as the lever 22C is supported at the projection 23A of the link arm 23.

When the front cover 21 is opened under state shown in FIG. 4, the rotation of the feeder cover 22 with regard to the main body 2 is controlled by the link arm 23 so that the feeder cover 22 is gradually closed toward the front cover 21, as shown in FIGS. 5 and 6. To be more specific, the projection 23A of the link arm 23 smoothly touches and slides from the leading end portion of the lever 22C of the feeder cover 22 toward the basal part thereof, so that the feeder cover 22 is gradually opened with a very small angle relative to the main body 2. When the front cover 21 is located at the first opened position, as shown in FIG. 6, the feeder cover 22 is substantially level with the front cover 21.

In other words, while the front cover is rotated by about 90°, the feeder cover 22 is controlled by the link arm 23 so that it is rotated just by about 60° in the case of the present exemplary embodiment. Thereby, when the front cover 21 is located at the first opened position, the feeder cover 22 is rotated to the second closed position, so that the engagement opening B1 of the feeder cover 22 is engaged with the engagement protrusion 21C of the front cover 21.

As the engagement opening B1 is engaged with the engagement protrusion 21C, it is possible to close the front cover 21 as shown in FIG. 3 while the feeder cover 22 is closed with respect to the front cover 21.

According to the above exemplary embodiment of the present invention, it is possible to obtain the following effects.

Even when the front cover 21 is opened with the feeing cover 22 being opened, the feeder cover 22 automatically approaches the front cover 21. Therefore, it is possible to prevent the feeing cover 22 from interfering with an object put on the installation surface of the laser printer 1. In addition, the rotation of the feeder cover 22 is limited at the link arm 23 that supports the front cover 21. Therefore, it is possible to reduce the number of parts and thus to simplify the apparatus.

When the front cover 21 is disposed at the first opened position with the feeing cover 22 being opened to the second opened position, the feeing cover 22 is rotated to the second closed position. Therefore, it is possible to make the feeder cover 22 approach the front cover 21 as close as possible and to further prevent the feeder cover from interfering with an object on the installation surface of the laser printer 1.

As the engagement opening B1 and the engagement protrusion 21C are engaged to each other, it is possible to keep the feeder cover 22 closed when closing the front cover 21. Therefore, it is possible to prevent a user from forgetting to close the feeder cover 22.

The rotation of the feeder cover 22 is limited at the link arm 23 that is not easily bent (i.e., has the high rigidity). Therefore, it is possible to securely engage the engagement opening B1 and the engagement protrusion 21C and to securely achieve the above effects.

When the feeder cover 22 is disposed at the second opened position with respect to the front cover 21 located at the first closed position, the lever 22C is contacted to the projection 23A. Under such state, while the front cover 21 is moved to the first opened position, the lever touches and slides to the projection 23A. Therefore, it is possible to smoothly close the feeder cover 22.

The feeding tray 31 is disposed under the rotational shaft 21A of the front cover 21 and the front cover 21 and the feeder cover 22 are substantially level with each other at the first opened position. Therefore, it is possible to pull out the feeding tray 31 even with the front cover 21 being opened.

In addition, the invention is not limited to the above embodiment and can be variously modified, as follows.

In the above embodiment, when the front cover 21 is moved to the first opened position, the feeder cover 22 is moved to the second closed position, i.e., is completely closed. However, the invention is not limited thereto. For example, it may be possible that when the front cover is moved to the first opened position, the feeder cover is not moved to the second closed position, i.e., is not completely closed.

In the above embodiment, the front cover 21 is adopted as a main cover. However, the invention is not limited thereto. For example, it may be possible to adopt a side cover or rear cover.

In the above embodiment, when the feeder cover 22 is opened with the front cover 21 closed, the lever 22C of the feeder cover 22 is contacted to the projection 23A of the link arm 23 and the feeder cover is thus kept at the second opened position. However, the invention is not limited thereto. For example, it may be possible that a part for keeping the feeder cover at the second opened position is provided for the front cover and the lever of the feeder cover and the projection of the link arm are not contacted to each other at the second opened position.

In the above embodiment, the swing arm 24 is provided so as to movably connect the link arm 23 to the main body 2. However, the invention is not limited thereto. For example, it may be possible to movably support the link arm with a U-shaped recess, instead of the swing arm 24.

In the above embodiment, the engagement opening B1 formed at the feeder cover 22 and the engagement protrusion 21C provided for the front cover 21 are adopted as the engagement part. However, the invention is not limited thereto. For example, a reverse concave-convex structure may be adopted.

In addition, the concave-convex structure of the rotational shaft 21A of the front cover 21 and the bearing of the main body 2 or the concave-convex structure of the rotational shaft 22A of the feeder cover 22 and the bearing of the front cover 21 may be reversed.

In the above embodiment, the invention is applied to the laser printer 1. However, the invention is not limited thereto. For example, the invention may be applied to the other image forming apparatuses, such as copier, complex machine and the like.

The invention claimed is:

1. An image forming apparatus comprising:

a main body having a first opening on a side surface thereof;

a main cover supported by the main body, having a second opening and rotatable between a first closed position and a first opening position, the main cover covering the first opening at the first closed position and uncovering the first opening at the first opening position;

a feeder cover supported by the main cover and rotatable between a second closed position and a second opening position, the feeder cover covering the second opening at the second closed position and uncovering the second opening at the second opening position; and a link arm jointed to the main body at a first joint, jointed to the main cover at a second joint and stopping the rotation of the main cover at the first opening position while the main cover rotates, the first joint movable relative to the main body, and the link arm rotating the feeder cover from the second opening position toward the second closed position when the main cover rotates from the first closed position with the feeder cover at the second opening position.

2. The image forming apparatus according to claim 1, wherein the link arm rotates the feeder cover from the second opening position to the second closed position when the main cover rotates from the first closed position to the first opening position.

3. The image forming apparatus according to claim 2, wherein the main cover and the feeder cover have an engagement portion which keeps the feeder cover at the second closed position.

4. The image forming apparatus according to claim 1, further comprising:

a projection provided for the link arm; and a lever elongate from the feeder cover, wherein the link arm rotates the feeder cover from the second opening position toward the second closed position when the main cover rotates from the first closed position with the feeder cover at the second opening position by engaging the lever and the projection.

5. The image forming apparatus according to claim 4, wherein the lever abuts the projection when the feeder cover is at the second opening position and the main cover is at the first closed position, and the projection touches and slides along the lever while the main cover rotates to the first opening position with the feeder cover at the second opening position.

6. The image forming apparatus according to claim 1, further comprising:

a feeding tray drawable from the side surface of the main body and arranged below a center of the rotation of the main cover, wherein the main cover and the feeder cover are positioned at upper side as compared to the upper surface of the feeding tray when the main cover is at the first opening position.

7. The image forming apparatus according to claim 6, wherein the center of the rotation of the feeder cover is arranged upper side as compared to the center of the rotation of the main cover when the main cover is at the first closed position.

8. The image forming apparatus according to claim 5, wherein a surface of the lever on which the projection touches and slides is a tapered or cylindrical surface.

* * * * *